US011172745B2

(12) United States Patent
Tam et al.

(10) Patent No.: US 11,172,745 B2
(45) Date of Patent: Nov. 16, 2021

(54) HAIR DRYER ATTACHMENT

(71) Applicant: CONAIR CORPORATION, Stamford, CT (US)

(72) Inventors: Ka Yan Connie Tam, San Po Kong (HK); Tsz Hang Yuen, San Po Kong (HK); Shu Sang Chow, San Po Kong (HK)

(73) Assignee: Conair LLC, Stamford, CT (US)

( * ) Notice: Subject to any disclaimer, the term of this patent is extended or adjusted under 35 U.S.C. 154(b) by 78 days.

(21) Appl. No.: 16/510,588

(22) Filed: Jul. 12, 2019

(65) Prior Publication Data

US 2021/0007457 A1 Jan. 14, 2021

(51) Int. Cl.
*A45D 20/12* (2006.01)
*A45D 20/50* (2006.01)

(52) U.S. Cl.
CPC ..... *A45D 20/50* (2013.01); *A45D 20/12* (2013.01)

(58) Field of Classification Search
CPC ..... A45D 20/50; A45D 20/12; A45D 20/08; A45D 20/28; A45D 20/48; A45D 20/52
USPC ..... 34/96–98, 283
See application file for complete search history.

(56) References Cited

U.S. PATENT DOCUMENTS

| | | | | |
|---|---|---|---|---|
| 4,230,279 | A * | 10/1980 | Forsberg | A45D 20/122 239/559 |
| 5,729,907 | A | 3/1998 | Santhouse et al. | |
| 6,094,837 | A | 8/2000 | Cantor | |
| 6,775,922 | B2 * | 8/2004 | Langley | A45D 20/12 34/96 |
| 7,124,763 | B2 | 10/2006 | Hafemann | |
| 9,578,945 | B2 | 2/2017 | Han | |
| 2002/0078587 | A1 * | 6/2002 | White | A46B 17/02 34/97 |
| 2002/0112362 | A1 | 8/2002 | Correa et al. | |
| 2007/0034225 | A1 | 2/2007 | Chen | |
| 2009/0100698 | A1 * | 4/2009 | Primm | A45D 20/122 34/97 |
| 2016/0120286 | A1 * | 5/2016 | Han | A45D 20/122 132/116 |

FOREIGN PATENT DOCUMENTS

| | | | |
|---|---|---|---|
| JP | H08256824 | A | 10/1996 |
| KR | 20040050046 | A | 6/2004 |
| KR | 200197508 | Y1 | 9/2009 |

* cited by examiner

*Primary Examiner* — John P McCormack
(74) *Attorney, Agent, or Firm* — Ohlandt, Greeley, Ruggiero & Perle, L.L.P.

(57) ABSTRACT

A hair dryer attachment that slides over and removably attaches to a barrel end of a hair dryer so that while a user uses a conventional brush with one hand, the user can hold the hair dryer in the other hand and use the hair dryer attachment to comb intermittently during blowouts.

7 Claims, 8 Drawing Sheets

HAIR DRYER ATTACHMENT

BACKGROUND OF THE DISCLOSURE

1. Field of the Disclosure

The present disclosure is directed to a hair dryer attachment. More particularly, the present disclosure relates to such a hair dryer attachment that slides over a barrel end of a hair dryer.

2. Description of the Related Art

Hair dryers are used in combination with brushes or combs to assist with drying and/or styling hair. Generally, a user holds a first conventional brush in one hand to draw a tuft of hair from the scalp, and alternates between holding, in the other hand, a hair dryer and a second conventional brush in order to dry and style the user's hair. Thus, with the first brush in the one hand, the user holds the hair dryer in the other hand, and sets the hair dryer down to comb the hair with the second brush that is used to pull through the outstretched tuft to straighten and detangle hair.

Accordingly, the user repeatedly must set down the hair dryer, pick up the second brush, then set down the second brush, and pick up the hair dryer again to achieve styling. This undesirably leads to longer periods of time to dry and style hair, user fatigue, perhaps poor styling and enhances the possibility of dropping the hair dryer.

SUMMARY OF A PREFERRED EMBODIMENT

In a preferred embodiment of the present disclosure, there is provided a hair dryer attachment that slides over and removably attaches to a barrel end of a hair dryer.

In the preferred embodiment, the user can use a conventional brush to draw a tuft of hair of the user away from the scalp with one hand, and hold the hair dryer with the attachment in the other hand to both dry and pull through the outstretched tuft to straighten and detangle hair.

The present disclosure also provides comb teeth on the hair dryer attachment that have a metallic base plate for transferring heat so that, in use, the metallic base plate disperses heat evenly to hair as it is combed by the teeth.

The present disclosure further provides such a hair dryer attachment that has a generally cylindrical body that slides over a barrel end of the hair dryer and a plurality of comb teeth or bristles on an outer surface having a metallic base plate.

The present disclosure still further provides such a hair dryer attachment that has segments which are grippy and sized to flex and fit snugly over the barrel end of the hair dryer to hold the hair dryer attachment in place.

The present disclosure also provides such a hair dryer attachment that can also have the teeth or bristles forming one or more longitudinally aligned rows.

The above and other objects, features, and advantages of the present disclosure will be apparent and understood by those skilled in the art from the following detailed description, drawings, and accompanying claims. As shown throughout the drawings, like reference numerals designate like or corresponding parts.

DETAILED DESCRIPTION OF A PREFERRED EMBODIMENT OF THE PRESENT DISCLOSURE

Figure 1A:
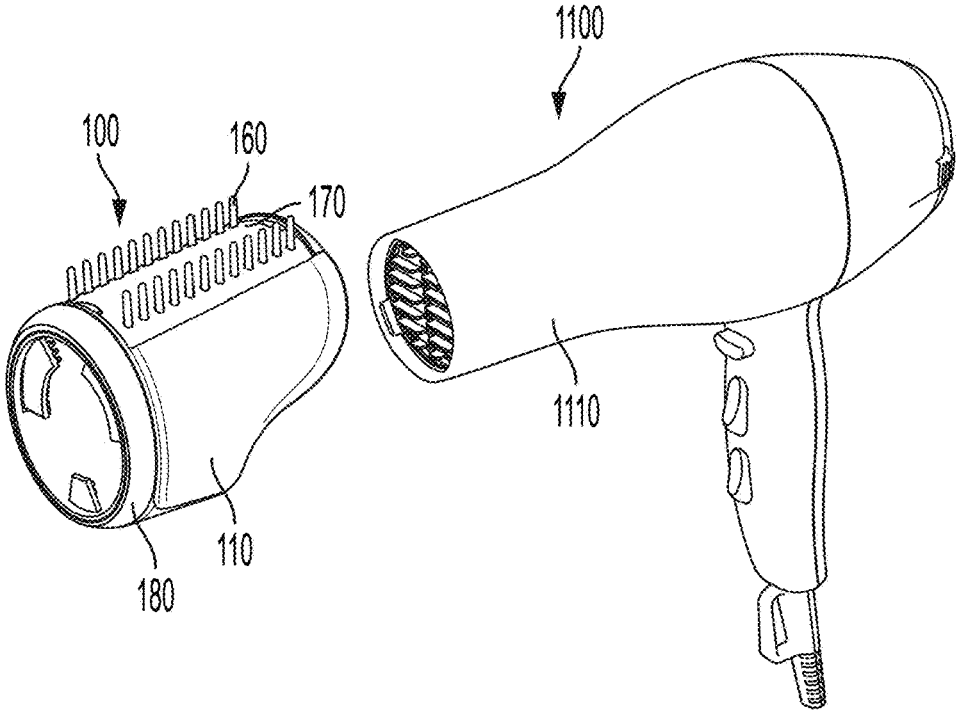
FIG. 1A is an exploded view of a preferred embodiment of a hair dryer attachment and conventional hair dryer.

A hair dryer attachment generally represented by reference numeral 100 according to a preferred embodiment of the present disclosure is shown in FIG. 1A. Hair dryer attachment 100 has a body 110 that is a generally cylindrical shape sized to slide over a barrel end 1110 of a hair dryer 1100.

Figure 1B:
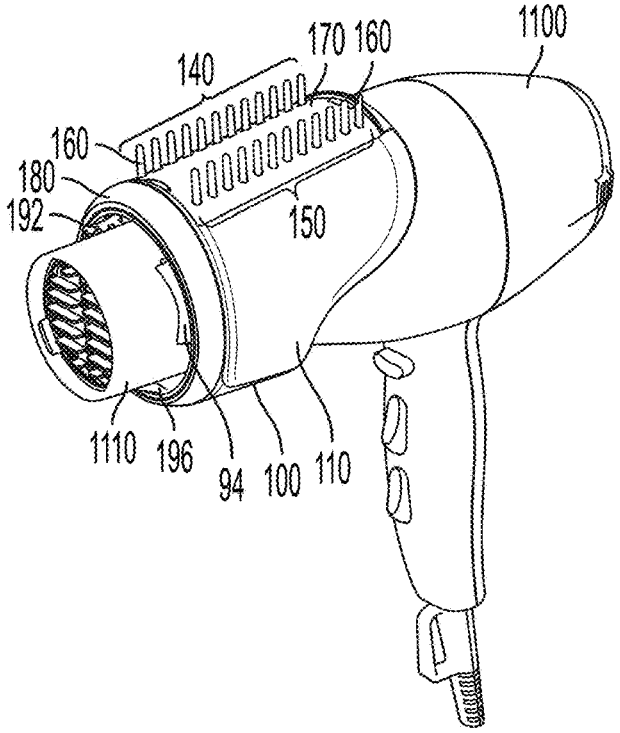
FIG. 1B is the hair dryer attachment of FIG. 1A on the conventional hair dryer also shown in FIG. 1A.
Figure 1C:
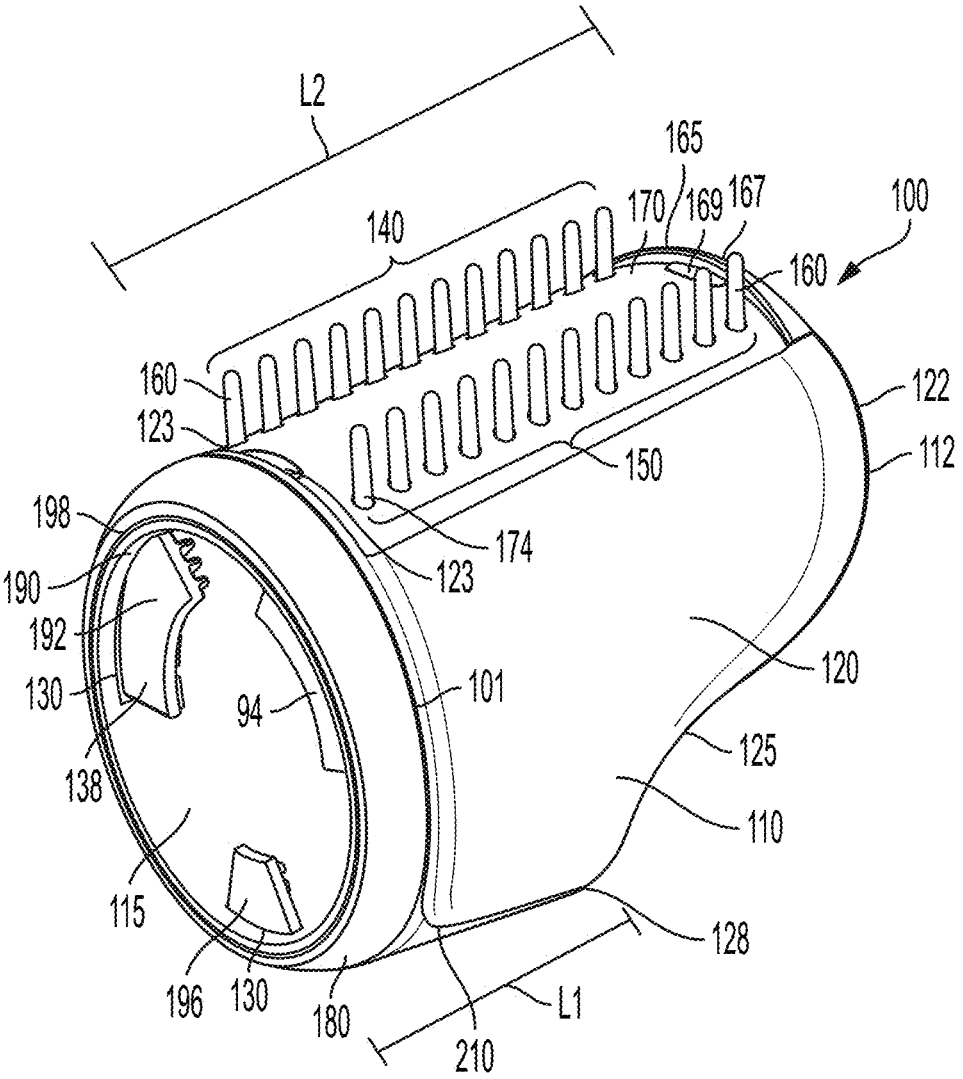
FIG. 1C is a perspective view of the hair dryer attachment.

Referring to FIGS. 1A-1C, body 110 has a wall 120 that has an interior 115 that forms a tubular opening. Wall 120 has a bottom portion 128 having length L1 and a top portion 122 with a length L2. Length L1 of bottom portion 128 is shorter than length L2 of top portion 122. Body 110 has curved portions 125, 126, shown more clearly in FIG. 2 between bottom portion 128 and top portion 122. Top portion 122 has an outer surface with a raised portion 123. Body 110 is made of rigid material, for example, plastic, metal, wood, or any other material that is suitable for use with a hair dryer that generates heat.

Hair dryer attachment 100 has teeth 160 on the outer surface of body 110. Teeth 160 are comb teeth or, alternatively, bristles, that extend outward from the outer surface of body 110. Teeth 160 preferably are formed in two rows 140, 150. Alternatively, teeth 160 can form one or more rows or another pattern that is configured to brush or comb through hair. Teeth 160 are connected to a teeth plate 165 that has a curve that is complementary to body 110. Teeth plate 165 has a ridge 167 that is complimentary in shape with rear end 112 of body 110 at top portion 122 to form a curved rear edge of hair dryer attachment 100. Teeth plate 165 also has a raised portion 169.

Teeth 160 are made of plastic, metal, wood, or any other material that is suitable for combing or brushing through hair and/or use with a hair dryer that generates heat, for example, plastic. Referring to FIG. 1C, hair dryer attachment 100 preferably has a metallic base plate 170 positioned on the outer surface of body 110. Metallic base plate 170 is a panel that has a curve that is complementary to body 110. Metallic base plate 170 has openings 174. Openings 174 form two rows that correspond to rows 140, 150 of teeth 160. Each tooth 160 extends through one of openings 174 in metallic base plate 170 so that the metallic base plate is positioned on top of teeth plate 165. Metallic base plate 170 is preferably made of, or has, a material that conducts heat.

Metallic plate 170 can transfer heat so that, in use, heated hair can be combed by teeth 160 of either or both rows 140, 150 while metallic base plate 170 disperses heat evenly to hair during combing. This simultaneous heating and combing assists in drying and styling the hair.

Hair dryer attachment 100 has a pad 180. Pad 180 is formed by a front portion 190 and a panel portion 210. Front portion 190 has a ring shape. Front portion 190 has tabs 192, 194, 196 that extend inward relative to the ring shape. Tabs 192, 194, 196 each have grippers 198. Grippers 198 form ridges on a surface of each of tabs 192, 194, 196 that faces rear end 112 of body 110. Three of apertures 130 of body 110 are shaped to receive tabs 192, 194, 196. Front portion 190 fits around a front end 114 of body 110 so that each of tabs 192, 194, 196 fits in one of the three of apertures 130 of body 110 securing front portion 190 to body 110.

Figure 3:
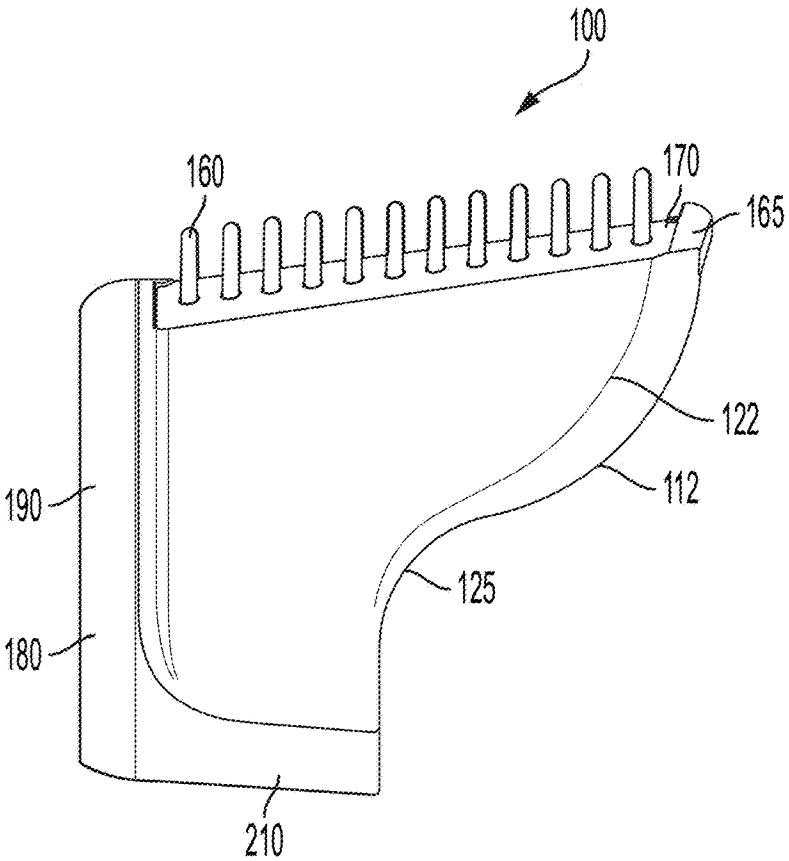
FIG. 3 is a side view of the hair dryer attachment that is opposite to the side view of FIG. 2.
Figure 2:
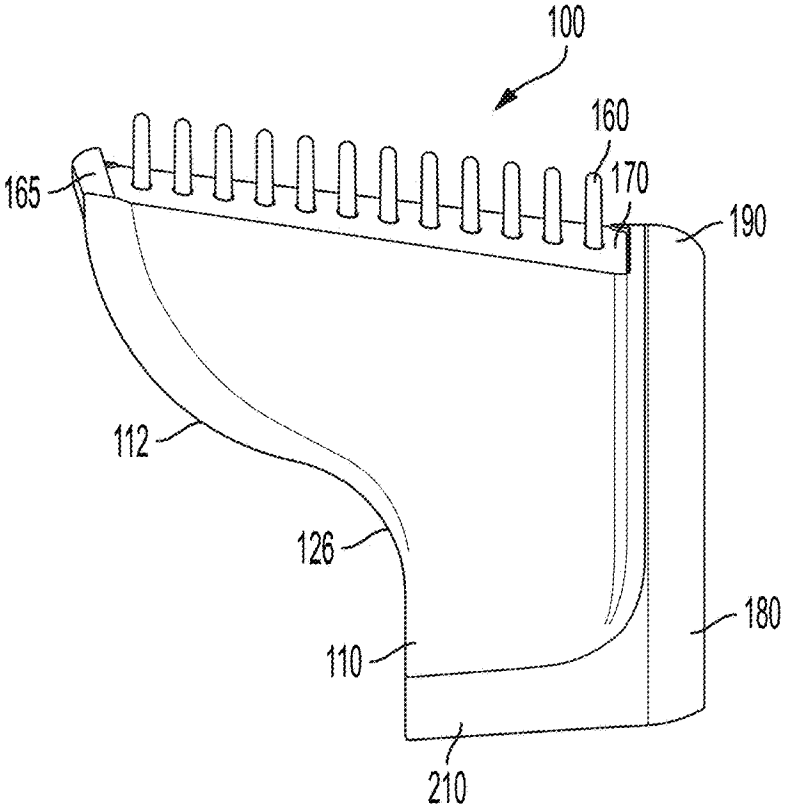
FIG. 2 is a side view of the hair dryer attachment.
Figure 4A:
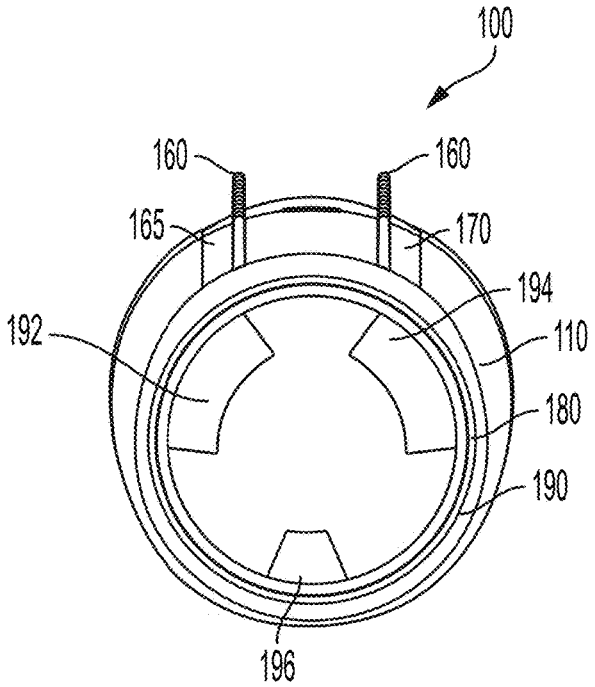
FIG. 4A is a front view of the hair dryer attachment.
Figure 4B:
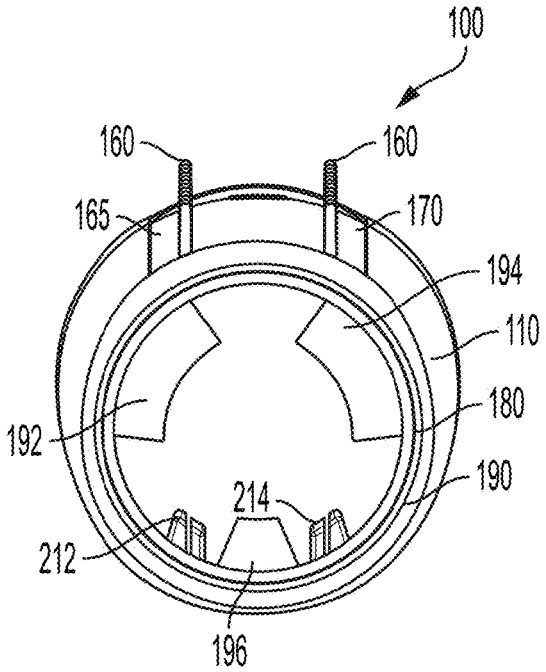
FIG. 4B is a front view of a modified embodiment of the hair dryer attachment.

Referring to FIGS. 2 and 3, panel portion 210 extends to rear end 112 of body 110. As shown in FIG. 4A, tabs 192, 194, 196 are positioned around front portion 190. As shown in FIG. 4B, hair dryer attachment 100 can be modified to have panel portion 210 that has tabs 212, 214 and two apertures 130 of body 110 can be shaped to receive tabs 212, 214 so that panel portion 210 abuts bottom portion 128 of body 110 to fit each of tabs 212, 214 in one of the two of apertures 130 of body 110 securing panel portion 210 to body 110.

Pad 180 is made of a material that is flexible, for example, rubber or plastic, that is more flexible than body 110.

Figure 5:
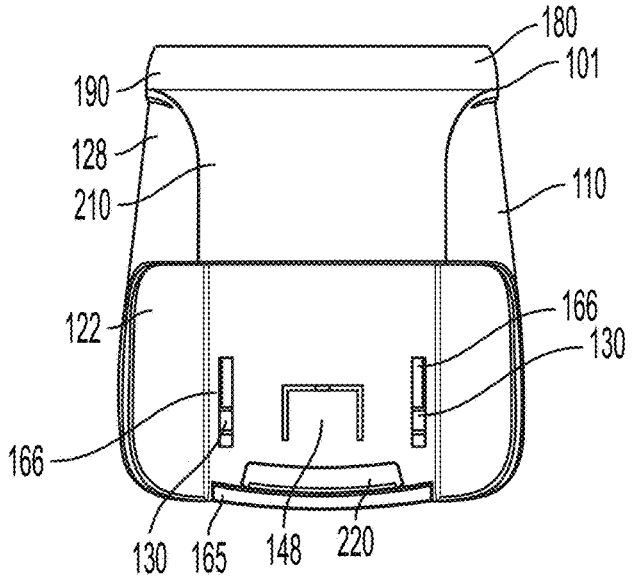
FIG. 5 is a bottom view of the hair dryer attachment.

Referring to FIG. 5, hair dryer attachment 100 has a rear pad 220 that is connected to body 110 between teeth plate 165 that is connected to teeth 160 and body 110. Rear pad 220 is made of a material that is flexible, for example, rubber or plastic, that is more flexible than body 110.

Still referring to FIG. 5, teeth plate 165 has hooks 166. Four of apertures 130 of body 110 are shaped to receive hooks 166. Each of hooks 166 fits into one of the four apertures 130 and is moved toward front end 114 of body 110 so that a portion of each of hooks 166 is adjacent the inner surface of body 110 to secure teeth plate 160 to body 110.

Figure 6:
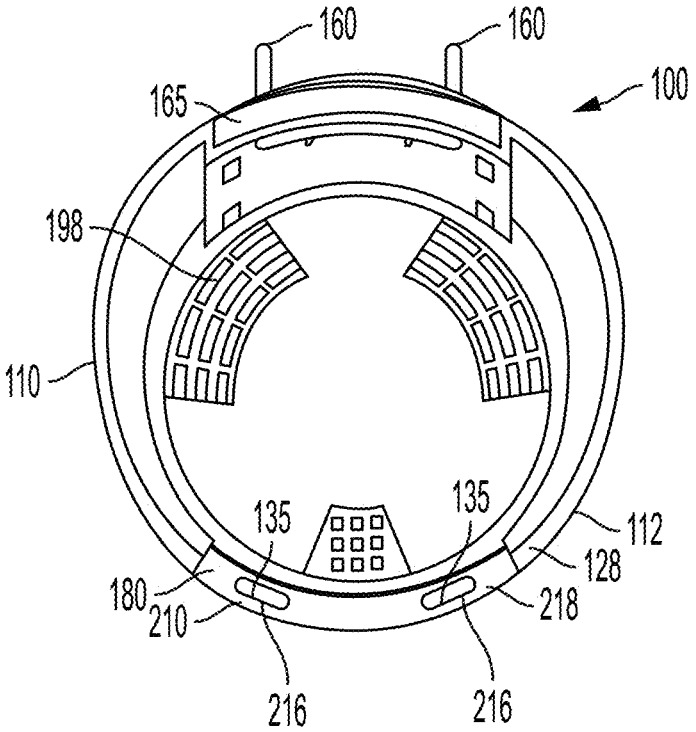
FIG. 6 is a rear view of the hair dryer attachment.

Referring to FIG. 6, panel portion 210 of pad 180 has holes 216 through a ridge 218. Rear end 112 of body 110 at bottom portion 128 forms projections 135. Each of projections 135 is inserted into one of holes 216 of panel portion 210 securing panel portion 210 to body 110 at rear end 112 of body 110.

Referring to FIGS. 7-10, rear pad 220 has a rear end portion 225 and top portions 230, 232. Rear end portion 225 has openings 222, 224 and top portions 226, 228 have openings 230, 232. Body 110 has projections 250, 252 on rear end 112 at top portion 122 and projections 254, 256 on the outer surface of top portion 122. When assembled, opening 222 receives projection 250, opening 224 receives projection 252, opening 230 receives projection 254, and opening 232 receives projection 256 to connect rear pad 220 to body 110.

Still referring to FIGS. 7-10, body 110 has loops 118. When assembled, hooks 166 of teeth plate 160 fit through apertures or holes 130 of body 110 and slide under loops 118 to connect teeth plate 160 to body 110. Connecting teeth plate 165 to body 110 also secures rear pad 220 to body 110 by blocking movement of top portions 226, 228 to maintain projection 254 in opening 226 and projection 256 in opening 228. Ridge 167 also covers openings 222, 224 to maintain projection 250 in opening 222 and projection 252 in opening 224 when teeth plate 165 and body 110 are connected. Connecting teeth plate 165 to body 110 also secures metallic base plate 170 in position on teeth plate 115. Metallic base plate 170 has recesses 175, 176 and protrusions 177, 178 on each side 171, 172. When teeth plate 165 is connected to body 110 raised portion 169 is received in recess 175 and raised portion 123 is received in recess 176 and each of protrusions 177, 178 is received in an opening or aperture 130 on top portion 122 that is adjacent each of loops 118 to maintain metallic base plate 170 on teeth plate 165. Teeth plate 165 forms a surface that is continuous such that air, for example, from hair dryer 1100, flowing radially outward from inside or from inner surface of interior 115 of body 110 is blocked by teeth plate 165. Body 110 also forms a surface that blocks flow of the air, for example, from hair dryer 1100, flowing radially outward from the inside or interior 115 of body 110.

Figure 7:
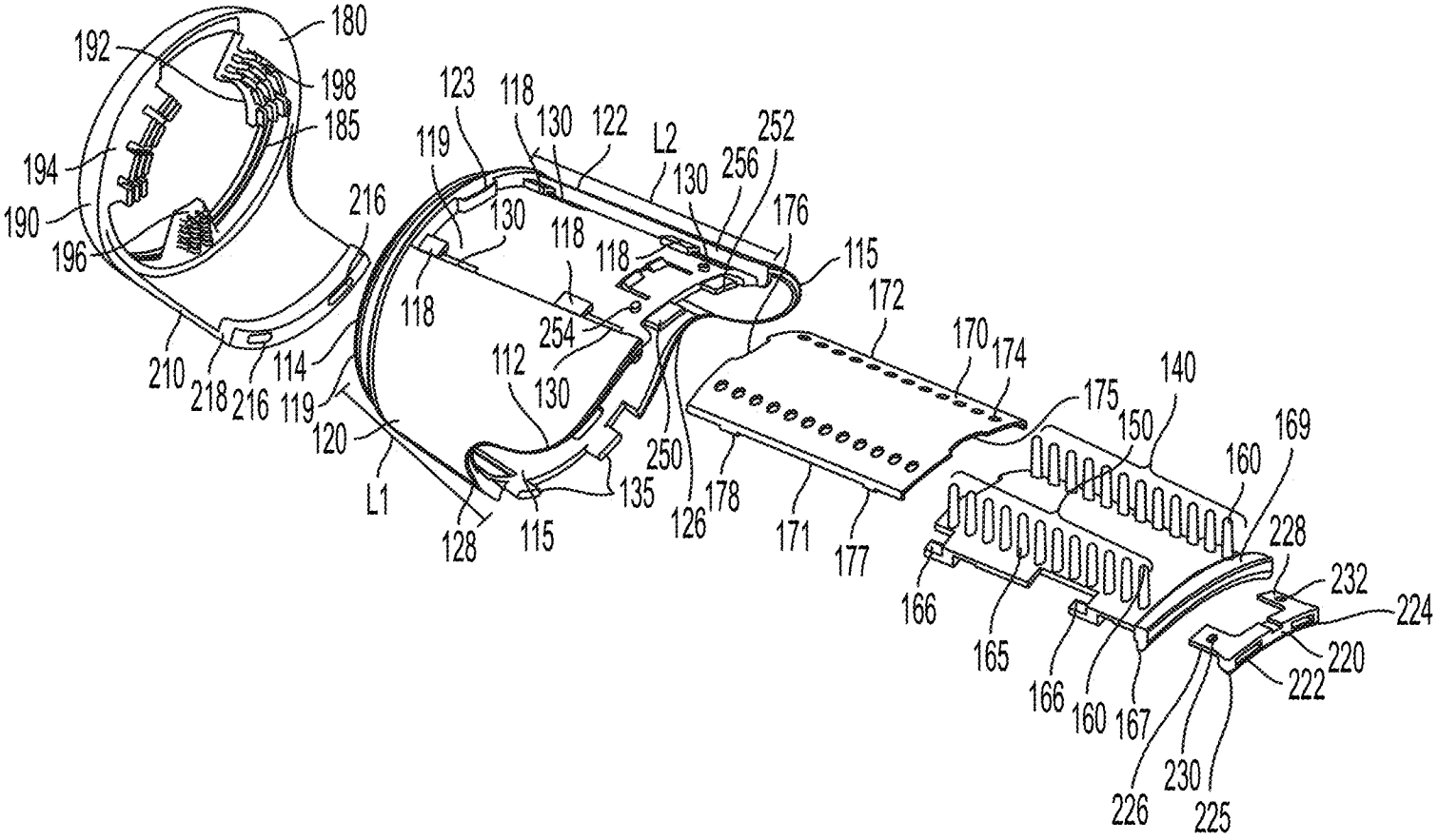
FIG. 7 is an exploded view of the components of the hair dryer attachment.
Figure 8:
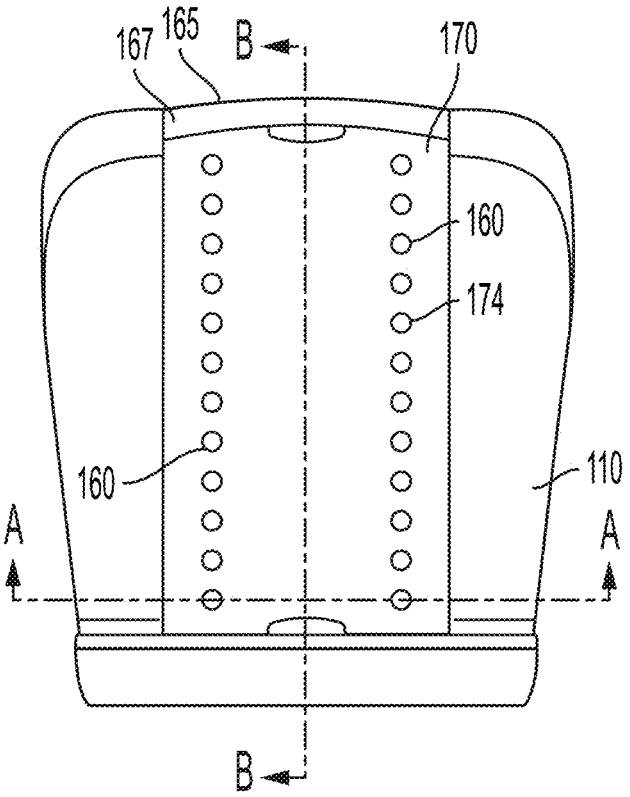
FIG. 8 is a top view of the hair dryer attachment.
Figure 9:
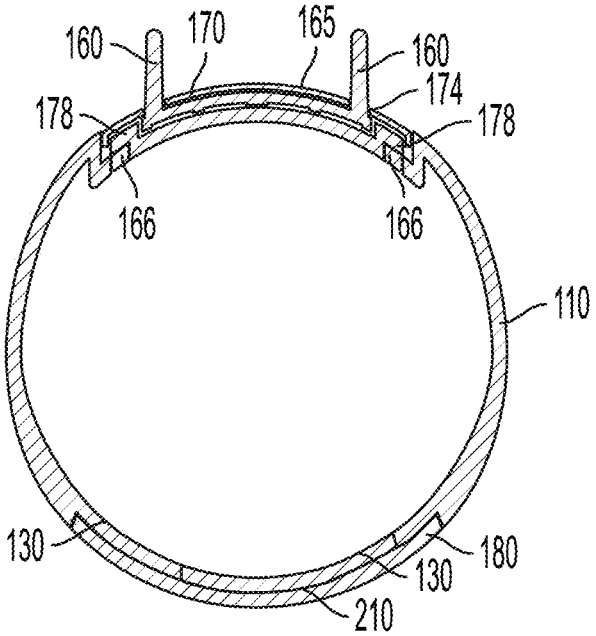
FIG. 9 is a front cross-sectional view of the hair dryer attachment taken along line A-A of FIG. 8.
Figure 10:
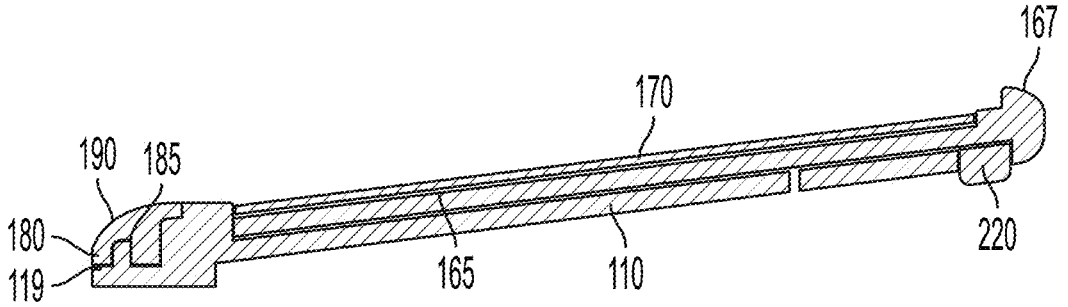
FIG. 10 is a side cross-sectional view of the hair dryer attachment taken along line B-B of FIG. 8.
Figure 10:
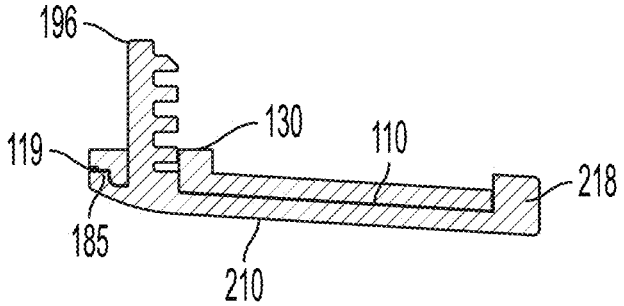

Referring to FIGS. 7 and 10, the front end 114 of body 110 forms a ridge 119. Pad 180 has a complementary groove 185 that extends through front portion 190 and panel portion 210. When pad 180 is connected to body 110, ridge 119 is received in groove 184 to secure the front end 114 of body 110 to pad 180.

In use, hairdryer attachment 100 slides over barrel end 1110 of hair dryer 1100. In a preferred embodiment shown in FIG. 1B, hair dryer attachment 100 has a body 110 that is a generally cylindrical shape sized to slide over a barrel end 1110 of a hair dryer 1100. Once body 110 is slide on barrel end 1110, tabs 192, 194, 196 that each have grippers 198, and rear pad 220 deform to grip barrel end 1110 of hair dryer 1100 and provide friction to maintain hair dryer attachment 100 on barrel end 1110. During use, the user can use a conventional brush with one hand while holding the hair dryer in the other hand and use hair dryer attachment 100 to comb intermittently during blowouts without having to set the dryer down. For example, the brush hand can draw a tuft of hair away from the scalp and hold it in place while teeth 160 of hair dryer attachment 100 pulls the outstretched tuft to straighten and detangle hair. This is done without having to set down hair dryer 1100 and pick up a second brush.

Further, metallic base plate 170 transfers heat so that, in use, hair just heated by hair dryer 1100 can be combed by teeth 160 and metallic base plate 170 disperses heat from the recently heated hair evenly to the same or other hair as it is combed. This further assists in drying and styling the hair.

Accordingly, by using hair dryer attachment 100 the user can reduce the time to dry and/or style hair, reduce the risk of dropping the hair dryer, reduce the risk of dropping the second conventional brush, and/or reduce fatigue in the user's hands or arms over using a hair dryer without hair dryer attachment 100.

While the present disclosure has been described with reference to one or more exemplary embodiments, it will be understood by those skilled in the art, that various changes can be made, and equivalents can be substituted for elements thereof without departing from the scope of the present disclosure. In addition, many modifications can be made to adapt a particular situation or material to the teachings of the present disclosure without departing from the scope thereof. Therefore, it is intended that the present disclosure will not be limited to the particular embodiments disclosed herein, but that the disclosure will include all aspects falling within the scope of a fair reading of appended claims.

What is claimed is:

1. A hair dryer attachment comprising:

a body having a substantially cylindrical shape that is configured to slide over a barrel end of a hair dryer;

a plurality of teeth or bristles each having a base and a free end extending outward from the body; and a metallic base plate at the base of the plurality of teeth or bristles that conducts heat so that recently heated hair combed by the plurality of teeth or bristles has heat dispersed to the same and other hair as hair is combed, the metallic base plate being a panel that has a curve that is complementary to body wherein the base of each of the plurality of teeth or bristles are each connected to a teeth plate, and wherein the teeth plate connects to the body.

2. The hair dryer attachment of claim 1, wherein the body is rigid.

3. A hair dryer attachment comprising:

a body having a substantially cylindrical shape that is configured to slide over a barrel end of a hair dryer;

a plurality of teeth or bristles each having a base and a free end extending outward from the body; and a metallic base plate at the base of the plurality of teeth or bristles that conducts heat so that recently heated hair combed by the plurality of teeth or bristles has heat dispersed to the same and other hair as hair is combed, wherein the metallic base plate has a plurality of openings so that each of the plurality of openings receives one of the plurality of teeth or bristles wherein the base of each of the plurality of teeth or bristles are each connected to a teeth plate, and wherein the teeth plate connects to the body.

4. A hair dryer attachment comprising:

a body having a substantially cylindrical shape that is configured to slide over a barrel end of a hair dryer;

a plurality of teeth or bristles each having a base and a free end extending outward from the body; and a metallic base plate at the base of the plurality of teeth or bristles that conducts heat so that recently heated hair combed by the plurality of teeth or bristles has heat dispersed to the same and other hair as hair is combed, wherein the base of each of the plurality of teeth or bristles are each connected to a teeth plate, wherein the teeth plate connects to the body, and wherein the teeth plate forms a surface that is continuous so that air flowing radially outward is blocked by the teeth plate.

5. The hair dryer attachment of claim 4, wherein the body forms a surface that blocks flow of the air radially outward.

6. A hair dryer attachment comprising:

a body having a substantially cylindrical shape that is configured to slide over a barrel end of a hair dryer, the body having a wall with an inner surface and an outer surface opposite the inner surface, the inner surface forms a hollow interior;

a plurality of teeth or bristles each having a base and a free end extending outward from the body; and a plurality of tabs extending inward from the inner surface of the body to grip the barrel end of a hair dryer, the plurality of tabs each having a surface that forms a free end so that the surface bends about the inner surface of the body to contact the barrel end of the hair dryer when the hair dryer attachment is attached to the hair dryer the plurality of tabs fold in a direction parallel with the axis of the barrel.

7. The hair dryer attachment of claim 6, wherein the plurality of tabs are positioned at a front end and a back end of the body.

* * * * *